United States Patent [19]

Jones

[11] 3,932,075

[45] Jan. 13, 1976

[54] ROTOR AND SEALING GRID FOR ROTARY ENGINES

[75] Inventor: Charles Jones, Hillsdale, N.J.

[73] Assignee: Curtiss-Wright Corporation, Wood-Ridge, N.J.

[22] Filed: Mar. 21, 1975

[21] Appl. No.: 560,870

[52] U.S. Cl. ..... 418/121; 418/142

[51] Int. Cl.[2] ..... F01C 19/08; F01C 19/02

[58] Field of Search ..... 418/119–121, 418/142

[56] References Cited

UNITED STATES PATENTS

| | | | |
|---|---|---|---|
| 3,102,518 | 9/1963 | Anderson | 418/142 |
| 3,193,188 | 7/1965 | Bentele | 418/121 |
| 3,323,713 | 6/1967 | Wenderoth et al. | 418/121 |
| 3,485,440 | 12/1969 | Greif et al. | 418/119 |

FOREIGN PATENTS OR APPLICATIONS

| | | | |
|---|---|---|---|
| 1,300,123 | 7/1969 | Germany | 418/142 |

*Primary Examiner*—William L. Freeh
*Assistant Examiner*—O. T. Sessions
*Attorney, Agent, or Firm*—Raymond P. Wallace; Arthur Frederick

[57] ABSTRACT

An inexpensive rotor and cooperating sealing grid for trochoidal rotary engines, in which the gas seals at each side of the rotor are simple circular elements interlocking and coacting with the sealing elements at the rotor apexes, whereby the chambers of variable volume formed between the rotor working faces and the housing are isolated from each other and from axial leakage of gas, the circular gas seals also serving as oil seals between the rotor and the housing side walls.

7 Claims, 6 Drawing Figures

ROTOR AND SEALING GRID FOR ROTARY ENGINES

BACKGROUND OF THE INVENTION

This invention relates to rotary combustion engines of trochoidal type, and more particularly to the means of sealing the operating chambers against gas leakage, and of sealing against the leakage of lubricating fluid from the shaft region into the operating chambers.

In the prior art, the customary gas sealing practice for such engines requires a slot extending axially across each rotor apex, a sealing bar disposed in each slot and resiliently urged in the radially outward direction to maintain it in sweeping sealing relation with the inner peripheral surface of the housing, a pin in each side face of the rotor in each apex region receiving the ends of the apex sealing bar, and a plurality of side sealing strips on each side of the rotor with one strip close to and approximately parallel to each working face of the polygonal rotor, with the ends of the side sealing strips either butting against the pins in the apex region or overlapping a shoulder formed on the pin. Oil sealing of the shaft region is achieved by one or more rings in each rotor side face, coaxial with the rotor axis.

Such a system is complex, expensive to manufacture, and difficult to assemble. Some attempts have been made to simplify the problem, as in U.S. Pat. No. 3,853,439 issued Dec. 10, 1974 to Charles Jones, wherein the pins at the rotor apexes have been omitted and a circular gas seal used at the rotor side faces, with the apex sealing bars butting radially against the side seals. However, this arrangement requires that each apex seal be formed of four or even five pieces, with the radial legs of the seal ends extending deeply into the rotor body, and there is the possibility of gas leakage through the spring channel behind the circular seal from one chamber to another. Although such an amount of leakage is acceptable for some uses, in more critical applications it is preferable that such a channel be precluded, as in the present invention.

U.S. Pat. No. 3,251,541 issued May 17, 1966 to Hanns-Dieter Paschke is a similar attempt, but of even greater complexity. The apex seals have radially extending legs at each end butting against a circular side seal, but the radial legs of the apex seals are composed of four pieces each, so that each apex seal assembly consists of nine pieces.

A further atempt is shown in U.S. Pat. No. 3,193,188 issued July 6, 1965 to Max Bentele, wherein in FIG. 13 apex pins nest in notches cut part way through the circular side seals. This not only weakens the side seals, but can cause ineffective sealing operation of the apex seals, which thus are limited in radial travel. Also, good sealing practice requires that the apex sealing bars travel back and forth in the circumferential direction across the width of their slots, in order to permit gas pressure to each the underseal space from the working chamber having the higher pressure at any given portion of the cycle. The lodgement of the apex seal legs in the notches in the side seals links all the apex seal bars together, so that if one seal moves across its slot it must rotate the side seal ring within its groove, and hence move the other apex seals in the same direction, which is contrary to what is desired. Alternatively, frictional forces on the side seals may be sufficient to rotate the rings and move the apex seals when no such movement is desired.

The present invention overcomes these limitations of the prior art.

SUMMARY

The present invention provides a sealing system for a rotary engine of trochoidal type requiring only a minimum number of parts, with a simple gas side seal of circular form which may also serve as an oil seal, seated in an easily fabricated circular groove in the rotor side face, the circular side seal passing through arcuate grooves in the apex pins in such a manner as not to cause interlocking of the pins and apex seals which are thus independently movable.

It is therefore an object of this invention to provide an improved sealing system for trochoidal rotary engines.

A further object is such an improved system having a simplified gas and oil seal coacting with the apex sealing assembly.

Other objects and advantages will become apparent on reading the following specification in connection with the accompanying drawings.

DESCRIPTION OF A PREFERRED EMBODIMENT

Although the invention is herein described in terms of a trochoidal engine having a two-lobed housing and a three-apexed rotor with the rotor gear cast into the rotor body, it is to be understood that the invention may be incorporated in engines having other numbers of lobes in the housing and generally polygonal rotors, with the rotor gear differently applied.

Figure 1:
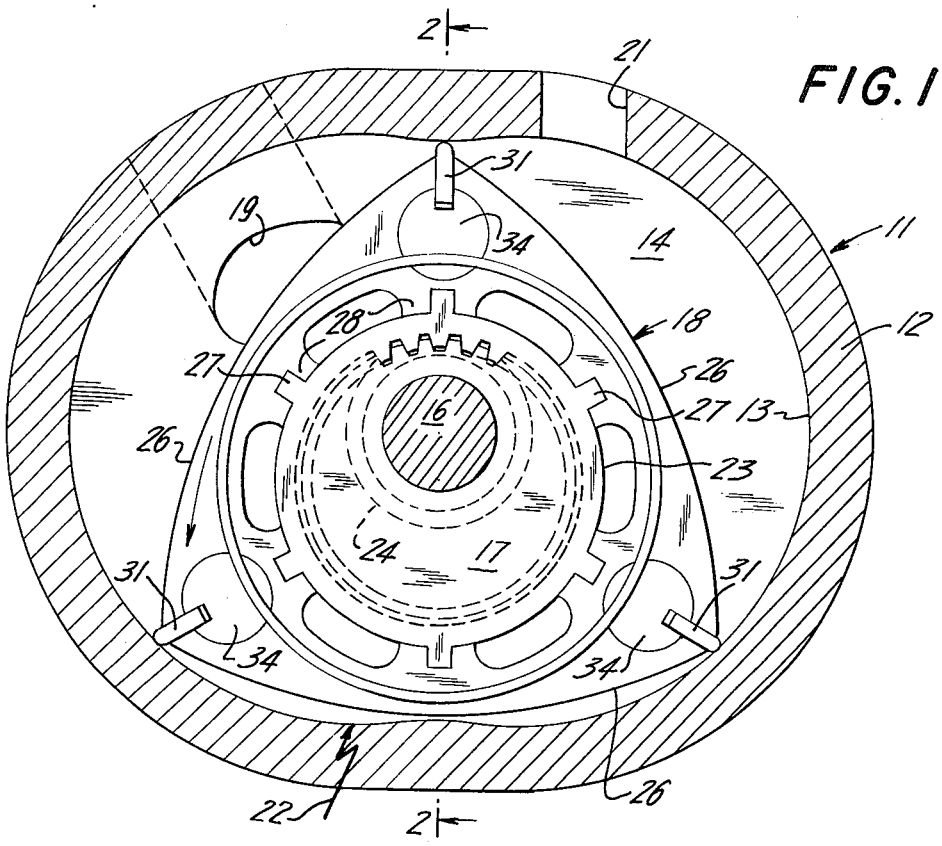
FIG. 1 shows a view of a rotary engine according to the invention, with one side wall removed, and taken generally along line 1—1 of FIG. 2.
Figure 2:
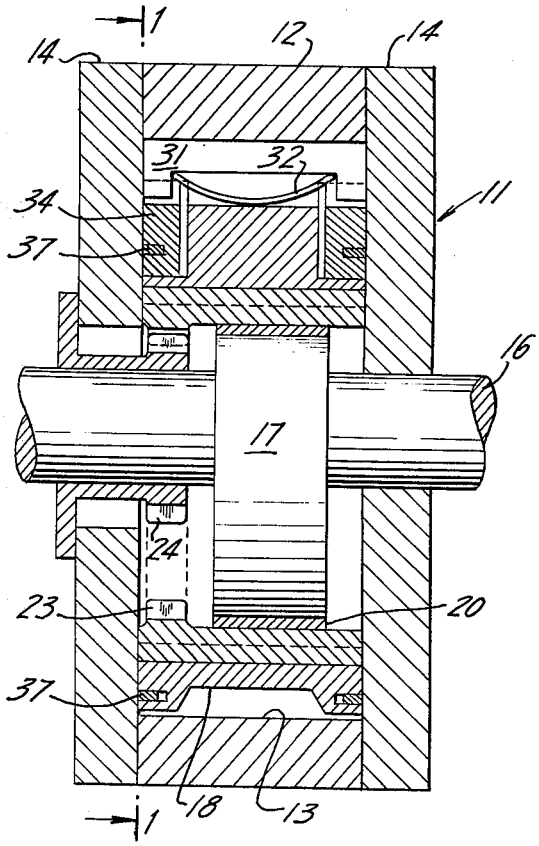
FIG. 2 is a cross-sectional elevation taken on line 2—2 of FIG. 1.

In FIGS. 1 and 2 there is shown a rotary engine 11 having a peripheral housing 12 with a two-lobed basically epitrochoidal inner surface 13, parallel side walls 14, a shaft 16 transpiercing the side walls and having an eccentric portion 17 disposed within the engine cavity, and a generally polygonal rotor 18 rotatably mounted on a bearing 20 disposed on the eccentric. The rotor shown has the generally triangular profile with convex arcuate sides which comprises substantially the inner envelope of the two-lobed epitrochoid shown. For epitrochoids having a different number of lobes, the inner envelope will also be generally polygonal and will have one more apex portion than the number of lobes in the epitrochoid.

The engine housing is provided with an inlet port 19 for intake of fresh gas by rotation of the rotor, and an exhaust port 21. Either or both of the ports may be disposed in the peripheral housing, or in either or both of the side walls, but in any case they will be in the general region of one of the cusps of the epitrochoid formed by the junction of the lobes. Ignition means as indicated by the lightning arrow 22 is provided in the compression region of the engine. In the case of an engine operating by fuel injection, the inlet port 19 will receive fresh air and a fuel injector may be disposed approximately at the location of arrow 22.

The rotor 18 bears an internal gear 23 in mesh with a fixed spur gear 24 mounted on a side wall 14 and surrounding the shaft 16, which gears assist in maintaining proper phasing relation between the rotor and the epitrochoidal surface 13 of peripheral housing 12. In the example shown the gear 23 is provided with external splines 27 which are retained and positioned by internal splines 28 of the rotor, but the internal gear may also be attached to the rotor by bolts, dowels, or other means known in the art.

The working chambers of variable volume formed between the housing and each working face 26 of the rotor require sealing against leakage, both from one chamber to another and leakage along the sides of the rotor. Each rotor apex has therein an axially extending slot 29 in which is disposed an apex sealing bar 31 which sweeps the trochoidal surface 13 in sealing relation therewith. The apex bars 31 are radially movable within their slots 29 and are resiliently urged in the radially outward direction by spring members 32.

Figure 3:
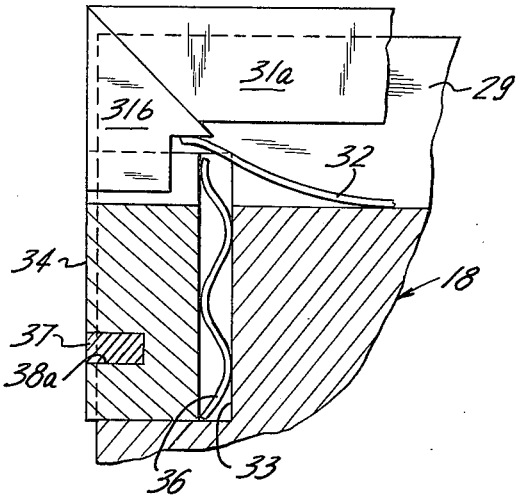
FIG. 3 is an enlarged fragmentary section of one corner, of the rotor shown in FIG. 2.

On each side of the rotor at each apex portion is a flatbottomed bore 33 (best shown in FIG. 3) of shallow depth, and in each bore 33 is disposed a cylindrical apex pin member 34 with a resilient member such as a Belleville washer or wave washer disposed between the pin and the bottom of the bore, urging the pin axially outwardly. Each apex pin 34 has in its circumference a slot 29a in the axial direction, of such dimension and so positioned that when the pin is disposed in its bore slot **29*a* is aligned with slot 29 in the rotor and comprises a portion thereof. Each slot 29*a* receives a radial leg of the apex seal bar 31, or the radially inner corner thereof. The apex seal 31 may be a single piece bar as shown in FIG. 2, extending the axial width of the engine cavity with its ends sweeping the side walls 14, or it may be divided along a slanting line from the region of its outward corners into pieces 31a and 31b as shown in FIG. 3. In the latter case the spring 32 bears against the generally triangular part 31b which comprises the radial leg of the apex sealing bar, the wedging action along the slanted division holding the seal parts axially and radially outwardly, as is known in the art. The radial dimension of the sealing bars, and consequently the depth of slots 29 and 29*a*** need be no greater than in the prior art.

Figure 4:
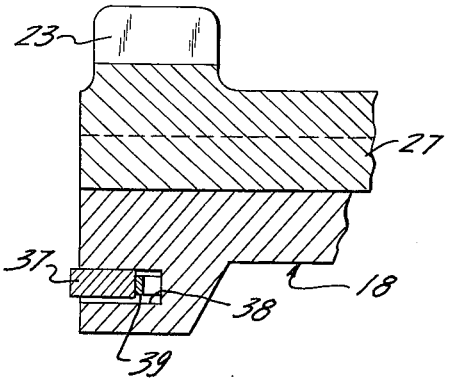
FIG. 4 is an enlarged fragmentary section of another corner of the rotor.
Figure 5:
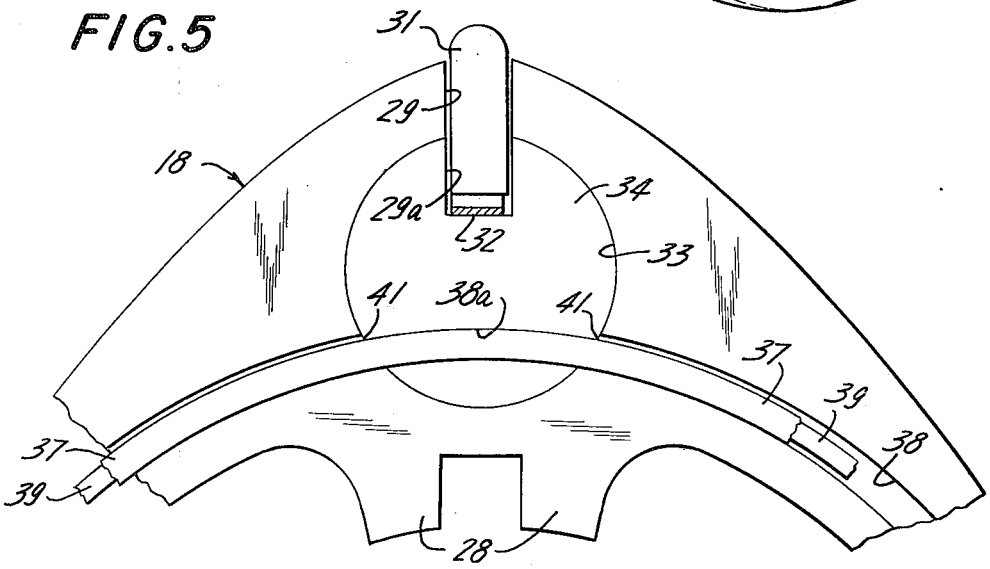
FIG. 5 is an enlarged fragmentary view of one apex of the rotor shown in FIG. 1.

The apex pins of the prior art are of relatively small diameter, since they are associated with side gas seals which lie in grooves very close to the perimeter of the rotor and along curves parallel to the perimeter; such side seals therefore point toward the apex portions of the rotor and have their ends either butting against the small pins or overlapping a portion thereof. The cylindrical pins 34 of the present invention are of much greater diameter, sufficiently large to coact with circular side sealing elements 37 disposed in annular grooves 38 in each side face of the rotor. The annular grooves 38 are formed on as large a circle as can be conveniently inscribed within the generally polygonal envelope of the rotor profile, as best seen in FIG. 1. Grooves 38 therefore do not approach the apex portions of the rotor, but curve progressively further inboard in each direction from the center region of each working face 26. Grooves 38 are sufficiently deep in the rotor body, as seen in FIG. 4, to contain the side sealing elements 37 with resilient members 39 disposed under them, wave springs or the like being suitable for members 39. The grooves 38 in the rotor may be slightly wider than the radial width of circular seals 37 (shown with exaggerated clearance in FIG. 5).

Grooves 38 run into each of the bores 33, and each large apex pin 34 has in its axially outward face a groove **38*a* of the same circular arc as grooves 38, so positioned in the pin 34 as to comprise a continuation of groove 38 when the pins are installed in the rotor, the groove 38*a* crossing the face of pin 34 radially inwardly from the bottom of slot 29*a*. However, grooves 38*a* in the pins have less radial width than the rotor grooves 38, providing only sufficient clearance to accommodate the radial thickness of side seals 37. Grooves 38*a* are also of less depth than grooves 38, the depth of 38*a* in the apex pins being only such that when the side seals 37 are installed their axially outward surfaces lie flush with the axially outward surfaces of the pins 34. Spring members 39 do not underlie the seals 37 in grooves 38*a*, resilient loading in the axial direction being obtained at the apex portions by the spring members 36 bearing against the pins 34**.

This arrangement precludes the existence of a channel behind the side seals at the apex portions, which would transfer leakage from one operating chamber to another across the apex portions, since gas pressure can enter the grooves 38 in the rotor because of their larger clearance.

The sealing grid described allows the circular side seals 37 to rotate within the grooves 38 and **38*a* if a rotary force develops as a result of friction against the side walls. Such rotary thrust will not be transferred to the apex seals 31**, which remain free to travel to one side or the other of their seal slots in response to chamber pressure, without interference from any motion the side seals may be subject to.

Figure 6:
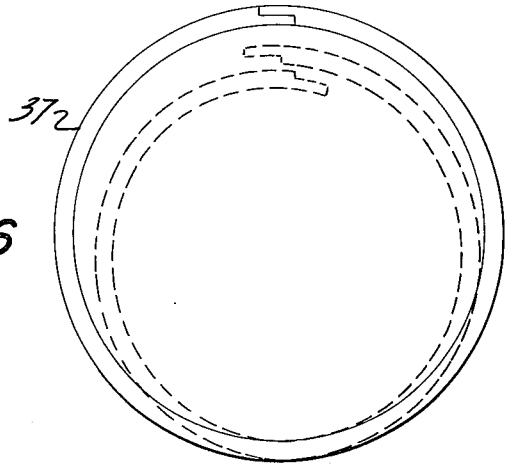
FIG. 6 is a view of the side seal element.

The side seals 37 may be formed similar to a piston ring, as shown in FIG. 6, with the ends forming a lap joint, the ring preferably being of resilient construction with a rest state, shown in dotted line in FIG. 6, in which it is contracted to a smaller diameter than its operating diameter, shown in solid line. Thus, when it is expanded into operating position at assembly its inner diameter will bear against the inner wall of grooves 38, and gas pressure against its outer diameter from the operating chambers will not shift it. If the ring were normally expansive in the outward direction it would tend to be thrust away from sealing contact with the outer groove wall by gas pressure from the operating chambers along the sides of the rotor.

If movement of apex seals 31 across their slots 29 causes any rotation of apex pins 34 within their bores 33, the outer corner edges 41 of grooves **38*a* will bear against the side seals 37 if any clearance should exist between grooves 38*a* and seals 37. Such pressure of corners 41** against the seals will prevent any minute transfer of gas from the chamber of higher pressure to the lower.

The annular side seals 37 not only act as gas seals, but may also serve as oil seals to retain lubrication within the interior of the rotor, since the side seals are in scraping relation to the side walls 14. However, if additional oil sealing means are desired, oil sealing rings of known type may be installed in the rotor side faces radially inside the seals 37.

What is claimed is:

1. A rotary mechanism having a housing with a peripheral wall having a multilobed inner surface and a pair of axially spaced side walls defining an inner cavity having a longitudinal axis, a generally polygonal rotor with a plurality of apex portions and having axially spaced side faces mounted within the cavity for rotation about a rotor axis parallel to and spaced apart from the housing axis, the rotor axis planetating about the housing axis, the rotor having a working face between each adjacent pair of apex portions and forming with the housing walls a plurality of working chambers of variable volume, wherein the improvement comprises:

a. the rotor having a slot therein at each apex portion extending axially from one side face to the other, and an apex sealing bar disposed in each apex slot and projecting radially therefrom and in sealing engagement with the inner surface of the peripheral housing walls and having its ends in sealing engagement with the adjacent side walls;

b. each rotor side face having a blind bore therein at each apex portion, each blind bore having disposed therein a cylindrical pin having a slot in its outermost periphery in the axial direction, the slot in the pin being aligned with the apex slot in the rotor and receiving a portion of the sealing bar;

c. each side face of the rotor having a circular groove therein coaxial with the rotor, and a circular side sealing member disposed in the circular groove and in sealing relation with the adjacent side wall and with an inner portion of said cylindrical pin;

d. the apex sealing bars and cylindrical pins and circular side seals all coacting and comprising a sealing grid isolating and sealing all the working chambers from one another said inner portion of said cylindrical pin and the innermost end of said apex seal being radially spaced and said cylindrical pin forming a portion of said sealing grid therebetween.

2. The combination recited in claim 1, wherein each cylindrical pin has in its axially exposed end face an arcuate groove of the same radius as the groove in the rotor side face and aligned therewith, a portion of the associated circular side sealing member being received in the arcuate groove of each pin.

3. The combination recited in claim 2, wherein the cylindrical pins and the circular side seals are resiliently urged in the axially outward direction into sealing contact with the associated side walls.

4. The combination recited in claim 3, wherein first resilient urging means is disposed in each portion of the rotor grooves between pin bores and under the circular side seals, and second resilient urging means is disposed in each pin bore under the cylindrical pins.

5. The combination recited in claim 4, wherein the arcuate grooves in the cylindrical pins are of substantially the same depth as the axial dimension of the circular side seals, and the axially outward faces of the circular side seals lie in substantially the same plane as the axially outward faces of their associated cylindrical pins.

6. The combination recited in claim 5, wherein each circular side seal is a resilient split ring having a rest diameter less than the diameter of the circular grooves in the rotor side faces, so that when the rings are expanded and disposed in the grooves the rings bear resiliently against the inner walls of the circular grooves.

7. The combination recited in claim 6, wherein the arcuate grooves in the cylindrical pin faces are disposed radially inwardly from the bottom of the apex seal slots and have a radial dimension closely accommodating the radial thickness of the circular side seals without excess clearance.

* * * * *